US005393447A

United States Patent [19]

Carlson et al.

[11] Patent Number: 5,393,447

[45] Date of Patent: Feb. 28, 1995

[54] COMPOSITION AND PROCESS FOR DESMUTTING AND DEOXIDIZING WITHOUT SMUTTING

[75] Inventors: Lawrence R. Carlson, Waterford; Philip M. Johnson, Southfield, both of Mich.

[73] Assignee: Henkel Corporation, Plymouth Meeting, Pa.

[21] Appl. No.: 88,998

[22] Filed: Jul. 9, 1993

[51] Int. Cl.[6] ..... C23F 4/00

[52] U.S. Cl. ..... 252/101; 252/89.1; 252/79.2; 252/79.3; 252/79.4; 252/186.1; 252/188.1; 252/188.2; 134/3; 134/27; 134/28; 134/41

[58] Field of Search ..... 252/79.2, 79.3, 79.4, 252/186.1, 186.21, 188.1, 188.2, 101, 89.1; 134/3, 41, 27, 28

[56] References Cited

U.S. PATENT DOCUMENTS 2,441,300 5/1948 Bunte et al. ..... 252/79.2
4,883,541 11/1989 Tadros ..... 134/41
4,886,616 12/1989 Yamasoe et al. ..... 252/79.2

FOREIGN PATENT DOCUMENTS 0196668 10/1986 European Pat. Off. .
48-42537 12/1973 Japan .
413227 5/1974 U.S.S.R. .

OTHER PUBLICATIONS

AU-B-23652/88, "Aluminum Surface Cleaning Agent", Jan. 27, 1989, Nippon Paint Co., LTD.

*Primary Examiner*—Richard D. Lovering
*Assistant Examiner*—Valerie Fee
*Attorney, Agent, or Firm*—Ernest G. Szoke; Wayne C. Jaeschke; Norvell E. Wisdom, Jr.

[57] ABSTRACT

A chromium and ferricyanide free aqueous deoxidizer/-desmutter for aluminum and magnesium alloys contains nitric acid, ferric ions, persulfate, and molybdate and preferably also sulfate, fluoride, and ethoxylated acetylenic diol surfactant.

21 Claims, No Drawings

COMPOSITION AND PROCESS FOR DESMUTTING AND DEOXIDIZING WITHOUT SMUTTING

BACKGROUND OF THE INVENTION

1. Field of the Invention

This invention relates to compositions and processes for desmutting metal surfaces, particularly the surfaces of aluminum and magnesium and their alloys that contain at least 45 % by weight of aluminum or magnesium, more particularly aluminum alloys containing sufficient copper to form smut on their surfaces easily when dissolving. The compositions and processes are also useful for deoxidizing unsmutted surfaces and achieve deoxidizing without forming smut on the surfaces or otherwise staining them. ("Deoxidizing" is to be understood herein as the removal from the surface of metals of oxide films and other adherent inorganic materials that would reduce adhesion to subsequently desired protective coatings such as conversion coatings and/or paints and the like. With most deoxidizing agents, there is a perceptible but controlled dissolution of the underlying metal while the deoxidizing agent is in contact with it. In contrast, "desmutting" is to be understood herein as the removal, without significant attack on the underlying metal, of powdery and usually darkly colored, residues produced on a treated metal surface by some prior cleaning, etching, and/or deoxidizing treatment.)

2. Statement of Related Art

Since the development of copper containing aluminum aerospace alloys several decades ago, the conventional deoxidizing compositions have normally included concentrated nitric and/or sulfuric acid and chromates, with fluorides, ferric ions, oxidizers such as persulfate and peroxide, and ferricyanide all serving as frequently used optional ingredients. In recent years there has been environmentally driven incentive to avoid chromates and ferricyanides, but no fully satisfactory deoxidizer free from these materials is believed to have been developed.

DESCRIPTION OF THE INVENTION

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, unless expressly stated to the contrary: percent, "parts of", and ratio values are by weight; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description, and does not necessarily preclude chemical interactions among the constituents of a mixture once mixed; specification of materials in ionic form implies the presence of sufficient counterions to produce electrical neutrality for the composition as a whole; and any counterions thus implicitly specified should preferably be selected from among other constituents explicitly specified in ionic form, to the extent possible; otherwise such counterions may be freely selected, except for avoiding counterions that act adversely to the stated objects of the invention. Also, the term "gram mole" is applied to ionic as well as molecular constituents.

SUMMARY OF THE INVENTION

It has been found that molybdate and persulfate ions have a favorable synergistic effect in nitric acid based desmutting compositions, permitting the elimination of both chromates and ferricyanides while producing excellent results in desmutting aluminum and magnesium and their alloys, including copper containing alloys. The same compositions can be used if desired as deoxidizers for metal surfaces that have oxide films that are unwanted, and accomplish deoxidizing effectively without forming smut on the deoxidized surfaces or otherwise staining the surfaces, if not allowed to dry on the surface before rinsing.

Accordingly, one embodiment of the invention is an aqueous composition that comprises, preferably consists essentially of, or more preferably consists of, water and:

(A) nitric acid;
(B) ferric ions;
(C) persulfate (i.e., $S_2O_8^{-2}$, also called "peroxydisulfate") anions; and
(D) molybdate or condensed molybdate anions; and, optionally but preferably,
(E) fluorine containing anions; and, optionally but preferably,
(F) sulfuric acid or sulfate ions; and, optionally but preferably,
(G) surfactant, and optionally,
(H) a dye or other colorant.

Various embodiments of the invention include working compositions for direct use in treating metals, concentrates from which such working compositions can be prepared by dilution with water, processes for treating metals with a composition according to the invention, and extended processes including additional steps that are conventional per se, such as rinsing, and, particularly advantageously, subsequent conversion coating and/or painting or some similar overcoating process that puts into place an organic binder containing protective coating over the metal surface treated according to a narrower embodiment of the invention. Articles of manufacture including surfaces treated according to a process of the invention are also within the scope of the invention.

DESCRIPTION OF PREFERRED EMBODIMENTS

For a variety of reasons, it is preferred that compositions according to the invention as defined above should be substantially free from many ingredients used in compositions for similar purposes in the prior art. Specifically, it is increasingly preferred in the order given, independently for each preferably minimized component listed below, that these compositions, when directly contacted with metal in a process according to this invention, contain no more than 1.0, 0.35, 0.10, 0.08, 0.04, 0.02, 0.01, 0.001, or 0.0002, percent of each of the following constituents: hexavalent chromium; silica; silicates that do not contain at least four atoms of fluorine per atom of silicon; ferricyanide; ferrocyanide; thiourea; pyrazole compounds; sugars; gluconic acid and its salts; glycerine; α-glucoheptanoic acid and its salts; and myoinositol phosphate esters and salts thereof. It is also preferred that the content of ferrous ions be no greater than 5, more preferably not greater than 3, or still more preferably not greater than 1.1, % of the content of ferric ions.

Furthermore, in a process according to the invention that includes other steps than the desmutting/deoxidizing treatment with a composition as described above, when avoidance of environmental pollution is an overriding consideration, it is preferred that none of these other steps include contacting the surfaces with any composition that contains more than, with increasing preference in the order given, 1.0, 0.35, 0.10, 0.08, 0.04, 0.02, 0.01, 0.003, 0.001, or 0.0002% of hexavalent chromium. On the other hand, the desmutting/deoxidizing process taught herein can be advantageously used prior to chromate conversion coating or anodizing in a chromate containing solution, where one of the latter treatments is needed.

In an acidic aqueous composition to be used according to the invention, either directly as a working composition or as a source of active ingredients for making up a more dilute working composition, the concentration of component (A) as described above is preferably at least 1 gram mole per liter of composition ("M"), more preferably is at least 2.0M, or still more preferably is at least 3.7M. Independently, in a working composition the concentration of component (A), with increasing preference in the order given, is not greater than 6.8, 5.9, or 5.4, M.

For component (B), the concentration in either a concentrated or a working composition, with increasing preference in the order given, preferably is at least 0.05, 0.09, 0.15, or 0.22, M; and independently this concentration in a working composition preferably is not greater than 0.70, 0.62, 0.45, 0.37, or 0.30, M.

For component (C), the concentration in either a concentrated or a working composition, with increasing preference in the order given, preferably is at least 0.020, 0.042, 0.051, or 0.060, M; and independently this concentration in a working composition preferably is not greater than 0.19, 0.16, 0.10, 0.091, or 0.080, M.

For component (D), the concentration in either a concentrated or a working composition with increasing preference in the order given, preferably is at least 0.01, 0.022, 0.044, or 0.052, M; and independently this concentration in a working composition preferably is not greater than 0.5, 0.24, 0.17, 0.12, 0.075, or 0.066, M. Also independently in a working composition, the ratio of component (C) to component (D) preferably is within the range from 0.4:1.0 to 1.5:1.0, more preferably from 0.6:1.0 to 1.2:1.0, or still more preferably from 0.80:1.0 to 0.95:1.0.

For component (E), the Component is preferably supplied by soluble fluoride or bifluoride ions, more preferably the latter, which are counted as their stoichiometric equivalent as fluoride ions, as are hydrofluoric acid and any complex fluoromettallic acids or their ions that may be present; the concentration as fluoride in either a working or concentrated composition, with increasing preference in the order given, preferably is at least 0.01, 0.028, 0.070, 0.090, or 0.105, M; and independently this concentration in a working composition preferably is not greater than 0.28, 0.19, 0.14, or 0.119, M. (While not being bound by theory, it is believed that the principal function of the fluoride ion content is to promote slight etching of the surface treated, so that the use of fluoride is particularly desirable when treating alloys, such as the 2xxx and 7xxx series of aluminum alloys, that contain relatively high percentages of elements that are electrochemically more noble than aluminum. When treating such alloys, an etching rate in the range from $2.5\times10^{-4}$ to $10.2\times10^{-4}$ centimeters per hour is preferred during the desmutting operation. Such an etching rate will generally be achieved with the preferred amounts of fluoride ions noted above. With other alloys that are recognized in the art as more easily desmutted, fluoride ions may be reduced or even omitted altogether.)

For component (F), the concentration of sulfate ions, including the stoichiometric equivalent as sulfate ions of all the sulfuric acid present in the composition, in either a working or a concentrated composition, with increasing preference in the order given, preferably is at least 0.02, 0.09, 0.20, 0.42, 0.51, or 0.69, M; and independently in a working composition this concentration preferably is not greater than 2.5, 1.9, 1.6, 1.2, 0.91, or 0.79, M.

For component (G), almost any surfactant that is effective to lower the surface tension and solubilize any organic contaminants present on the surface to be treated could be used in principle, but many kinds of surfactants are unstable in the highly oxidizing acidic composition. Another valuable function served by preferred surfactants is that of preventing spotty drying of the treated surfaces during the delays which can occur in practice between the time when treated metal surfaces are removed from contact with a desmutting-/deoxidizing composition according to this invention and the time when the surfaces are rinsed. Although it is known in the art that prompt rinsing after desmutting or deoxidizing is useful to minimize the chance of staining the treated surface, delays of two to three minutes are common in practice when desmutting large objects such as aircraft wing sections, and if the desmutting-/deoxidizing composition dries on the surface, staining of the dried areas is almost inevitable.

Surfactants which have been found to be satisfactorily stable, adequate in reducing surface tensions of the compositions while not making them intolerably prone to foaming, and effective in keeping dried areas from forming during transfer times up to at least 3 minutes between treatment and rinsing, and which are therefore particularly preferred, are ethoxylated acetylenic diols. These are preferably present in the working compositions in a concentration within the range from, with increasing preference in the order given, 0.01 to 10, 0.1 to 5, 0.25 to 4, 0.55 to 3.0, 0.75 to 2.5, 0.85 to 2.0, 0.85 to 1.5, 0.90 to 1.5, 0.85 to 1.2, or 0.90 to 1.10, grams per liter ("g/L") of the composition. Most preferably the surfactant component is composed of equal amounts of each of two ethoxylated tetramethyl decynediols, one with a hydrophile-lipophile balance ("HLB") in the range from 7 to 9 and the other with an HLB in the range from 11.5 to 14.5.

Component (H) is not believed to serve any technical purpose in the composition, but it is often valued as a safety precaution to workers to indicate the presence of strong acids by a prominent color such as red. An amount of dye or other colorant sufficient to be readily recognized by workers, without being so large as to impose a significant economic cost or adversely impact the intended technical functions of the composition, can be readily chosen by those skilled in the art.

In addition to the other characteristics noted above, a working composition according to the invention preferably has, with increasing preference in the order given, at least 15, 18, 20, 21, 22, or 23 "points" of free acid, such points being defined for this purpose as equal to the number of milliliters ("mL") of 1.0N strong alkali (such as sodium hydroxide) required to titrate a 5.0 mL sample of the composition, diluted with at least about 10 mL of deionized water containing a large excess of potassium fluoride to prevent precipitation of any heavy metal hydroxides during titration, to an end point with phenolphthalein indicator. Independently, a working composition preferably has, with increasing preference in the order given, no more than 35, 32, 29, 27, 26, or 25 points of free acid. Also and independently, a working composition according to the invention, preferably has an oxidation-reduction ("redox") potential, measured by comparing the potential of a platinum electrode immersed in the composition against a standard saturated calomel electrode immersed in the same composition, within the range of, with increasing preference in the order given, from 800 to 1100, from 900 to 1050, from 950 to 1035, from 975 to 1029, from 985 to 1020, from 991 to 1011, or from 996–1006, millivolts (hereinafter sometimes abbreviated "mv") more oxidizing than the standard electrode.

A workng composition according to the invention may be applied to a metal surface to be treated by any convenient method, several of which will be readily apparent to those skilled in the art. Immersion is the simplest and is believed most often used. However, spraying, roll coating, and the like could also be used.

The temperature during contact and time of contact between the composition according to the invention and the metal to be treated thereby may be varied within wide limits to achieve the desired effects, which can often be determined by visual inspection of the metal surface, after rinsing if necessary. As a general guide line, the temperature normally is preferably within the range from 15° to 35°, more preferably from 17° to 30°, or still more preferably from 20° to 26°C., and the time of contact normally is preferably within the range from 0.5 to 30, more preferably from 2 to 20, or still more preferably from 5 to 10, minutes.

After treatment according to this invention, the treated surfaces are normally rinsed with water before any subsequent treatment. As noted above, the rinsing preferably is completed as soon as practical after removing the treated surfaces from contact with the desmutting/deoxidizing composition, and if at all practicable should at least be rinsed before the desmutting-/deoxidizing composition has dried into place on any part of the surface. After rinsing the surfaces often are also dried. Rinsing, drying, and any subsequent treatments are generally those known per se in the art.

The invention is particularly advantageously adapted to the treatment of aluminum alloys 7150, 7075, 2024, 2324, and 6061; also to any aluminum or magnesium alloy surfaces that have been heavily shot peened or otherwise mechanically worked, and/or have been chemically milled or heavily chemically etched with alkaline compositions, before treatment according to the invention.

If it is desired to supply a concentrate from which the working composition can be prepared by dilution with water, the concentrate preferably does not contain the persulfate component, which has been observed to unstable in long term storage when mixed with the other components. Also, the nitric acid and surfactants are preferably supplied separately. A preferred concentrate according to the invention therefore contains only water and the sulfate, ferric ion, fluoride, and molybdate components.

During extended use of a composition according to this invention, new constituents may be introduced into the composition by dissolution of the metal objects treated, and some of the consituents of the bath may be consumed by reaction. Therefore, as with other similar treatments, if very long term operation is desired, it is advantageous to withdraw a portion of the composition continuously for removal of any unwanted constituents and replenishment of depleted desirable constituents. In some cases, only replenishment may be satisfactory, or no treatment of the composition at all may be required.

The practice of this invention may be further appreciated by consideration of the following, non-limiting, working examples.

EXAMPLES

Working Composition

A preferred working composition contains:

(A) 4.04M $HNO_3$ (provided by commercial concentrated nitric acid of 42° Baumè);

(B) 0.13M $Fe_2(SO_4)_3$ (provided by a commercially available 50 % aqueous solution);

(C) 0.0701M $(NH_4)_2S_2O_8$ (provided from commercial solid salt);

(D) 0.059M $(NH_4)_2Mo_2O_7$ (provided from commercial solid salt);

(E) 0.056M $NH_4HF_2$ (provided from commercial solid salt);

(F) 0.354M $H_2SO_4$ (provided from commercial concentrated sulfuric acid);

(G) 0.51 g/L of each of SURFYNOL TM 465 and 440 surfactants, commercially available from Air Products Co and described by the supplier as ethoxylated tetramethyl decynediols, the former with an HLB value of 13.0 and the latter with an HLB value of 8.0; and (H) 0.18 g/L of NYLOSAN TM RHODAMINE TM E-B 90 red dye.

(Note: The total concentration of ferric ions in this composition is 0.26M, because there are two ferric ions in each mole of ferric sulfate salt; the total concentration of fluoride ions is 0.112M, because there are two fluorine atoms in each mole of ammonium bifluoride, and the total concentration of sulfate ions is 0.74M, including 0.39M supplied by the ferric sulfate along with the 0.35M supplied by the sulfuric acid.)

This composition had a redox potential of 1001 mv and 24 free acid points.

Use of a Composition According to the Invention

Panels of Type 7150 aluminum, each panel containing at least one hole in order to make a more critical evaluation of the staining and/or smutting tendency, which is usually more pronounced in recesses and holes in parts being treated under practical conditions, were preetched to produce a reproducible oxidized and smutted surface by immersion for 7 to 10 minutes ("min") at a temperature within the range from 29.4° to 32.2° C. in an alkaline etching solution consisting of water and 120–150 g/L of sodium hydroxide, 11–26 g/L of sodium sulfide, 30–60 g/L of triethanol amine, and 18–50 g/L of dissolved aluminum.

After removal from the etching solution, the etched panels were allowed to stand in ambient air for 2–3 min, then successively rinsed twice for 2–3 minutes each time with deionized water at ambient temperature, then immersed in the above noted desmutting composition for 10 min at ambient temperature wit air agitation of the composition, allowed to stand in the ambient air for 2–3 min, then rinsed twice, the first time for 2–3 min and the second time for 1 min, with deionized water. Some of the panels were then conventionally anodized with satisfactory results. Others of the panels were allowed to dry and visually examined. Bright, smooth surfaces without smut were produced.

Concentrate Partial Composition

A preferred concentrate partial composition consists of 150 parts of sulfuric acid, 50 parts of ammonium molybdate, 250 parts of ferric sulfate, 16 parts of ammonium bifluoride, with the balance to 1000 parts being water.

What is claimed is:

2. A liquid desmutting/deoxidizing composition of matter according to claim 1, said composition consisting essentially of water and:

(A) nitric acid;
(B) ferric ions;
(C) persulfate anions; and
(D) molybdate or condensed molybdate anions; and, optionally, one or more of the following;
(E) fluorine containing anions;
(F) sulfuric acid or sulfate ions;
(G) surfactant; and,
(H) a dye or other colorant.

3. A desmutting/deoxidizing composition according to claim 2, wherein the concentration of component (A) is within the range from about 1 to about 6.8M, the concentration of component (B) is within the range from about 0.09 to about 0.74M, the concentration of component (C) is within the range from about 0.020 to about 0.19M, the concentration of component (D) is within the range from about 0.01 to about 0.17M, the concentration of fluoride is within the range from about 0.01 to about 0.28M, and the concentration of sulfate ions is within the range from about 0.02 to about 2.5M.

4. A desmutting/deoxidizing composition according to claim 3, wherein the concentration of component (A) is within the range from about 2.0 to about 5.9M, the concentration of component (B) is within the range from about 0.09 to about 0.59M, the concentration of component (C) is within the range from about 0.020 to about 0.16M, the concentration of component (D) is within the range from about 0.022 to about 0.12M, the concentration of fluoride is within the range from about 0.028 to about 0.28M, and the concentration of sulfate ions is within the range from about 0.09 to about 1.9M.

5. A desmutting/deoxidizing composition according to claim 4, wherein the concentration of component (B) is within the range from about 0.22 to about 0.45M, the concentration of component (C) is within the range from about 0.042 to about 0.10M, the concentration of component (D) is within the range from about 0.044 to about 0.075M, the ratio of the concentration of component (C) to the concentration of component (D) is within the range from about 046:1.0 to about 1.5:1.0, the concentration of fluoride is within the range from about 0.070 to about 0.19M, the concentration of sulfate ions is within the range from about 0.42 to about 1.2M, and the concentration of free acid is within the range from about 15 to about 40 points.

6. A desmutting/deoxidizing composition according to claim 5, wherein the concentration of component (A) is within the range from about 3.7 to about 5.4M, the concentration of component (B) is within the range from about 0.22 to about 0.37M, the concentration of component (C) is within the range from about 0.051 to about 0.091M, the concentration of component (D) is within the range from about 0.052 to about 0.075M, the ratio of the concentration of component (C) to the concentration of component (D) is within the range from about 0.6:1.0 to about 1.2:1.0, the concentration of fluoride is within the range from about 0.090 to about 0.14M, and the concentration of sulfate ions is within the range from about 0.51 to about 0.91M, and the concentration of free acid is within the range from about 20 to about 35 points.

7. A desmutting/deoxidizing composition according to claim 6, wherein the concentration of component (B) is within the range from about 0.22 to about 0.30M, the concentration of component (C) is within the range from about 0.060 to about 0.080M, the concentration of component (D) is within the range from about 0.052 to about 0.066M, the ratio of the concentration of component (C) to the concentration of component (D) is within the range from about 0.80:1.0 to about 0.95:1.0, the concentration of fluoride is within the range from about 0.105 to about 0.119M, and the concentration of sulfate ions is within the range from about 0.69 to about 0.79M, and the concentration of free acid is within the range from about 22 to about 25 points.

8. A process of contacting a smutted or oxidized metal surface with a composition according to claim 7 at a temperature within the range from about 20° to about 26° C. for a time within the range from about 5 to about 10 minutes and subsequently removing the surface from contact with said composition and rinsing the removed surface with water, so as to produce a bright surface.

9. A process according to claim 8, wherein the metal surface is a surface of Type 7150, 7075, 2324, 2024, or 6061 aluminum alloy.

10. A process of contacting a smutted or oxidized metal surface with a composition according to claim 6 at a temperature within the range from about 17° to about 30° C. for a time within the range from about 2 to about 20 minutes and subsequently removing the surface from contact with said composition and rinsing the removed surface with water, so as to produce a bright surface.

11. A process according to claim 10, wherein the metal surface is a surface of aluminum or aluminum alloy.

12. A process of contacting a smutted or oxidized metal surface with a composition according to claim 5 at a temperature within the range from about 15° to about 35° C. for a time within the range from about 0.5 to about 30 minutes and subsequently removing the surface from contact with said composition and rinsing the removed surface with water, so as to produce a bright surface.

13. A process according to claim 12, wherein the metal surface is a surface of aluminum, magnesium, or a magnesium or aluminum alloy.

14. A process of contacting a smutted or oxidized metal surface with a composition according to claim 4 at a temperature within the range from about 15° to about 35° C. for a time within the range from about 0.5 to about 30 minutes and subsequently removing the surface from contact with said composition and rinsing the removed surface with water, so as to produce a bright surface.

15. A process according to claim 14, wherein the metal surface is a surface of aluminum, magnesium, or a magnesium or aluminum alloy.

16. A process of contacting a smutted or oxidized metal surface with a composition according to claim 3 and subsequently removing the surface from contact with said composition and rinsing the removed surface with water, so as to produce a bright surface.

17. A process according to claim 16, wherein the metal surface is a surface of aluminum, magnesium, or a magnesium or aluminum alloy.

18. A process of contacting a smutted or oxidized metal surface with a composition according to claim 2 and subsequently removing the surface from contact with said composition and rinsing the removed surface with water, so as to produce a bright surface.

19. A process according to claim 18, wherein the metal surface is a surface of aluminum, magnesium, or a magnesium or aluminum alloy.

20. A concentrate composition for preparing a desmutting/deoxidizing composition according to claim 2, said composition consisting essentially of water and:

(A) at least 0.09M concentration of ferric ions;

(B) at least 0.01M total concentration of molybdate and condensed molybdate anions;

(E) at least 0.42M concentration of fluoride; and (F) at least 0.20M concentration of sulfate ions.

21. A concentrate composition according to claim 20, consisting essentially of about 150 parts of sulfuric acid, about 50 parts of ammonium molybdate, about 250 parts of ferric sulfate, about 16 parts of ammonium bifluoride, and the balance to 1000 parts of water.

22. A liquid desmutting/deoxidizing composition of matter consisting essentially of water and:

(A) nitric acid;

(B) ferric ions;

(C) persulfate anions; and (D) molybdate or condensed molybdate anions.

* * * * *

UNITED STATES PATENT AND TRADEMARK OFFICE

CERTIFICATE OF CORRECTION

PATENT NO. : 5,393,447

DATED : Feb. 28, 1995

INVENTOR(S) : Carlson et al.

It is certified that error appears in the above-indentified patent and that said Letters Patent is hereby corrected as shown below:

In column 10, line 14, "claim 22", should be moved and renumbered as: -- claim 1 --.

Signed and Sealed this

Twenty-ninth Day of August, 1995

Bruce Lehman

*Attest:*

BRUCE LEHMAN

*Attesting Officer*

*Commissioner of Patents and Trademarks*